United States Patent [19]

Scott

[11] Patent Number: 5,022,620

[45] Date of Patent: Jun. 11, 1991

[54] MOLDED MERCHANDISE DISPLAY BASE

[76] Inventor: George B. Scott, 1339 Washington St., P.O. Box 186, Des Plaines, Ill. 60016

[21] Appl. No.: 381,055

[22] Filed: Jul. 17, 1989

[51] Int. Cl.[5] ..... F16M 11/32

[52] U.S. Cl. ..... 248/188.6; 248/167; 248/188.7

[58] Field of Search ..... 248/519, 523, 528, 164, 248/188.6, 188.7, 511, 529, 431, 166, 167, 170, 188.1, 346; 211/196, 205

[56] References Cited

U.S. PATENT DOCUMENTS

| | | | |
|---|---|---|---|
| 2,606,522 | 8/1952 | Harris | 248/167 |
| 2,706,609 | 4/1955 | Sullivan | 248/167 |
| 3,307,814 | 3/1967 | Bogar | 248/188.7 |
| 3,387,808 | 6/1968 | Metcalf | 248/188.6 |
| 4,288,052 | 9/1981 | Scott | 248/188.7 |
| 4,763,866 | 8/1988 | Sinchok | 248/188.7 |

*Primary Examiner*—Ramon O. Ramirez

*Assistant Examiner*—Robert A. Olson

*Attorney, Agent, or Firm*—Fitch, Even, Tabin & Flannery

[57] ABSTRACT

Disclosed is a collapsible support base for supporting one end of an elongated shaft. The support includes four legs arranged in opposing pairs so as to form two cross members. The central portion of one cross member is flexible so as to be compressible to a smaller cross-sectional dimension, facilitating its insertion in a central portion of the other cross member. When interfitted, the two cross members are interlocked so that a preselected angular displacement between the legs thereof is maintained. In one embodiment, the cross members are pivotally interconnected one with the other at a central shaft-receiving portion. The central portions of the cross members may also include detent means for locking the cross members at a preselected angular position. The cross members may also be telescopically insertable one with the other with no provision for relative pivotal displacement.

3 Claims, 5 Drawing Sheets

180
178
150
176
182
156
152
170
154
155
194
166
172
188
168
160
158
162
196
202
200
208
210
212
186, 188
20
20
186
188

234
232
220
246
222
246
230
228
232
226
224
252
250

222
236
236a
234
238
238a
240
240a 228
222
230
226
224

222
236a
236
238a
238
240a
240
234

222
236
234
246
226
248
224
228
250

MOLDED MERCHANDISE DISPLAY BASE

FIELD OF THE INVENTION

The present invention pertains to collapsible support stands of a type which may be folded between an open, operable position and a closed position suitable for transport in a flat shipping package.

DESCRIPTION OF THE PRIOR ART

Stands used for the freestanding support of poles and the like may be employed in a variety of different applications. For example, a pole supported by such a stand may have a number of merchandise racks suspended therefrom, thereby providing a freestanding merchandise display. One example of this type of stand is given in U.S. Pat. No. 3,387,808 which discloses a collapsible stand having two pairs of opposing legs radially extending from the hub. By rotating one pair of legs relative to the other, the stand may be configured between an operable erected position and a collapsed position suitable for storage or shipping. In the patent, one pair of legs is welded to an upstanding pole and the other pair of legs is welded to rotatable disks mounted on the pole. A locking between the legs is achieved by butt ends of one set of legs abutting inner leg portions of the other set of legs. The locking action is subjected to large variations and tolerances because of the difficulty of precisely locating the butt ends. Accordingly, there is a need for an improved stand of this general type.

The above stand described in U.S. Pat. No. 3,387,808, is one example of a stand which is fabricated by welding together a relatively large number of individual components. For example, the legs and hub of the above-described patent must be welded together in separate individual operations. Attendant with such welded fabrication is the need to prepare the surfaces of the components to be welded so as to enhance the welded joinder, and the components must thereafter be aligned in a jig or other suitable device to hold the components, usually one pair at a time, in a desired position during the welding operation. Due to the nature of the welding operation, the components must be replated to restore their attractive finish. In addition to the laborintensive fabrication costs of stands constructed in this manner, an inventory of jigs and tools associated with each welding operation must be maintained. There is therefore a need to provide stands capable of forming comparable functions which require less labor for their production.

As mentioned above, the present invention is directed to stands which are collapsible from an open, operable position to a position suitable for storage and shipping. It is generally preferable that the stand be made collapsible into a relatively flat or low profile package which has long been the configuration preferred by the shipping industry.

SUMMARY OF THE INVENTION

It is an object of the present invention to provide a collapsible support stand made from molded components and particularly a stand which may be made from two molded components interfitted within one another so as to provide relative rotational positioning defining an open, operable position for the stand.

These and other objects, which will become apparent from studying the appended description and drawings, are provided in a support base for receiving one end of an elongated shaft so as to support portions of the shaft extending beyond the base, comprising:

four legs each having opposed inner and outer ends, the outer ends engaging a supporting floor; and a plurality of molded shaft-receiving collar means at the inner ends of at least two of the legs for receiving the shaft end and having means for releasable interlocking engagement with one another so that the legs are selectively configurable between an expanded, operable position where the legs are spread apart one from the other and a collapsed, storing position where the legs are placed adjacent one another.

BRIEF DESCRIPTION OF THE DRAWINGS

In the drawings, wherein like elements are referenced alike.

DETAILED DESCRIPTION OF THE PREFERRED EMBODIMENT

Figure 1:
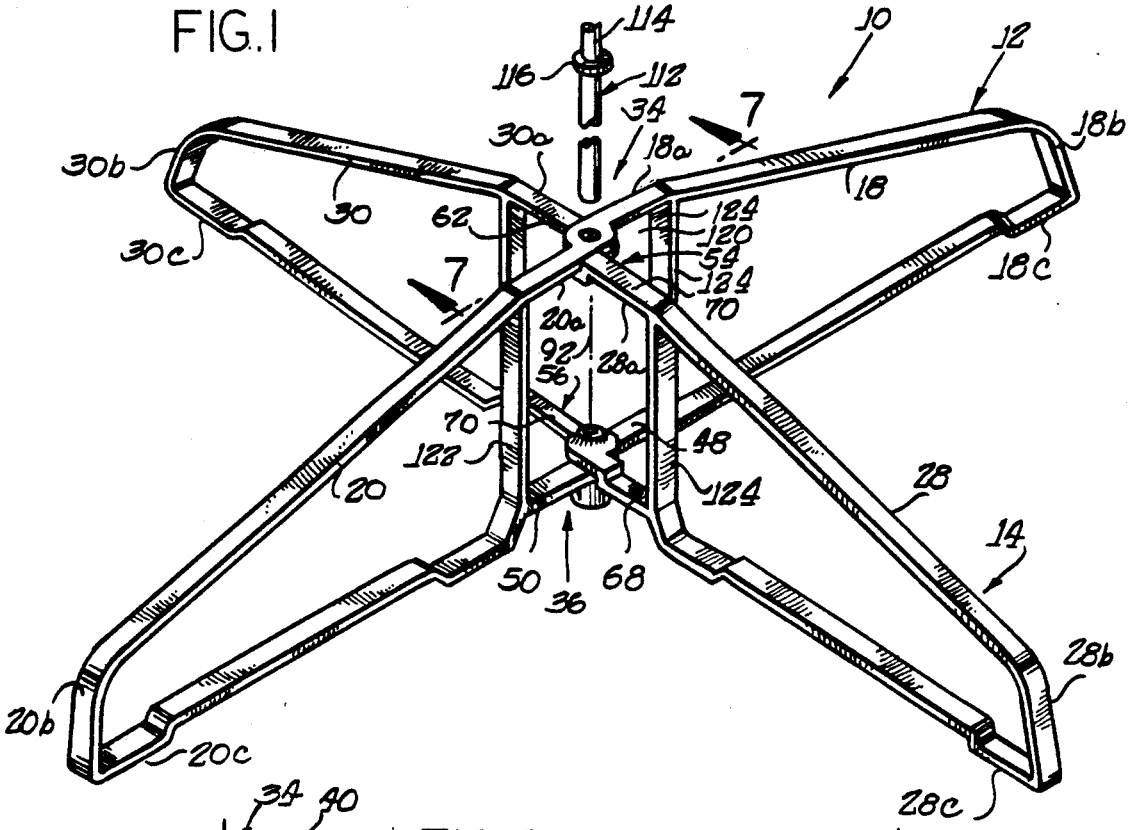
FIG. 1 is a perspective view of a preferred embodiment of a collapsible support stand illustrated in an open, operable position.

Referring now to the drawings, and initially to FIGS. 1–7, a first embodiment of a collapsible support base or stand according to the principles of the present invention is generally indicated at 10. As will be seen, the support base 10 may be constructed entirely from molded plastic components which are lightweight and relatively inexpensive to produce. The components of the support base may be molded in a wide variety of colors and textures. One particularly important commercial advantage of a support base constructed according to the present invention is that the components of the base do not require refinishing or other such modification. The bases constructed according to the present invention are readily assembled with a minimal labor investment.

Turning now to FIG. 1, the support base 10 in its more prominent aspects includes a pair of cross members generally indicated at 12, 14 which are interfitted at their central portions so as to allow a pivoting between the cross members. FIG. 1 shows the cross members in a first, open or expanded position where the cross members are displaced at right angles to each other. The cross members may also be rotated to the second, collapsed or storage position of FIG. 5.

Cross member 12 comprises a pair of opposed legs 18, 20 joined at their inner ends **18*a*, 20*a*. The legs 18, 20 include outer end portions 18*b*, 20*b* with floor-engaging foot portions 18*c*, 20*c*, respectively. Cross member 14 also comprises a pair of opposed legs 28, 30 joined together at their inner ends 28*a*, 30*a*, respectively. The legs 28, 30 have outer end portions 28*b*, 30*b* which include floor-engaging foot portions 28*c*, 30*c*, respectively. The cross members 12, 14** preferably comprise integral molded components having features to be described herein for their rotatable interlocking.

Although the cross members 12, 14 are preferably formed of molded plastic material, they could also be formed of molded or cast metal, if desired. Although metal cross members 12, 14 could be fabricated by welding short segments together, such is generally not contemplated by the present invention because of the economies of fabricating the components of the support base from molded plastic material and because other numerous advantages are obtained from a molded construction, as will be described herein.

Figure 2:
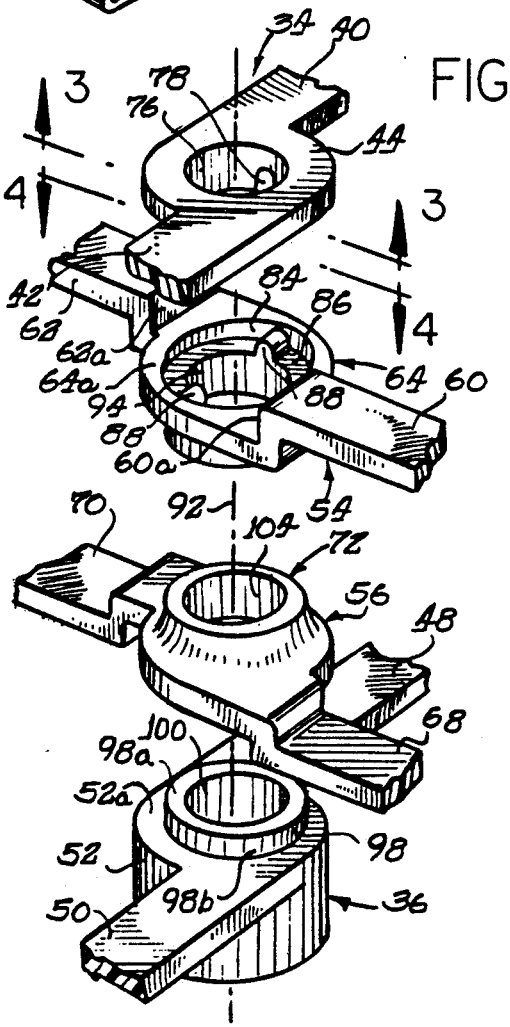
FIG. 2 is an exploded perspective view of the central collar portion of the stand of FIG. 1.
Figure 3:
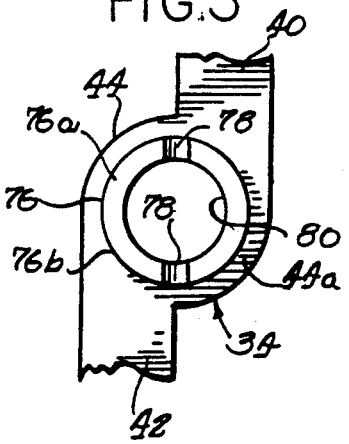
FIGS. 3 and 4 show two different portions of the collar assembly of FIG. 2.

Cross member 12 includes upper and lower midportions generally indicated at 34, 36, respectively. With reference to FIGS. 2 and 3, the upper midportion 34 includes elongated bar-like frame members 40, 42 of generally rectangular cross section, with the major surfaces thereof facing in vertically upward and downward directions. The frame members 40, 42 are joined by a disk-like collar 44. According to one aspect of the present invention, the frame members 40, 42 are elongated so as to extend in generally the same direction, but the frame members are laterally offset one from the other at the collar 44 so as to form the generally S-shaped configuration visible in FIGS. 1–3. When viewed from above, the frame members are offset in counterclockwise directions from a colinear alignment.

With reference to FIGS. 1 and 2, the lower midportion 36 of cross member 12 includes bar-like frame members 48, 50 joined together by a generally cylindrical socket 52. The frame members 48, 50 also have a rectangular configuration with the major surfaces facing in opposed upward and downward directions. As described above with reference to the upper midportion 34, the frame members 48, 50 extend in generally parallel directions but are laterally offset from one another to form a generally S-shaped configuration visible in the lowermost portion of FIG. 2. The offset is in the same sense or direction as that of the upper midportion.

The cross member 14 includes upper and lower midportions 54, 56, respectively. The upper midportion 54 includes a pair of bar-like frame members 60, 62 which lie in generally parallel planes which are laterally offset, one from the other to form a generally S-shaped configuration. The frame members 60, 62 are joined together at a collar member generally indicated at 64 (see FIG. 2). The lower midportion 56 of cross member 14 likewise comprises opposed bar-like frame members 68, 70 joined together at a collar 72.

As mentioned above, there is a lateral offset between the generally parallel frame members 68, 70. This offset has a sense opposite to that of the lateral offset of the adjacent underlying frame members 48, 50. For example, when viewed from above, the frame members 68, 70 are offset in clockwise directions, whereas the frame members 48, 50 are offset in counterclockwise directions so as to bring the cross members in intimate coextensive engagement illustrated in the collapsed shipping or storage position of FIG. 5.

Figure 4:
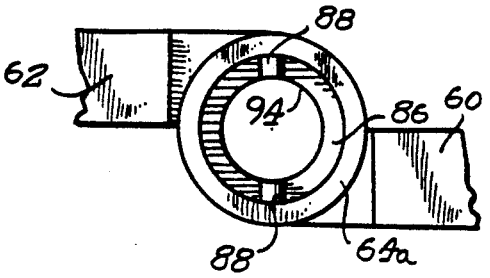

Turning now to FIGS. 2–4, the upper midportions 34, 54 of Cross members 12, 14 are rotatably interlocked one with the other. The collar 44 of midportion 34 includes a downwardly-extending cylindrical wall 76 (See FIG. 3). With reference to FIG. 3, which illustrates a bottom plan view of midportion 34, the cylindrical wall 76 includes an annular disk-like bearing surface **76*a* at its lower, free end. A concentric outer, annular bearing surface 44*a*, generally coplanar with the frame members 40, 42 is also provided. A pair of opposed recesses 78 are formed in the cylindrical wall 76**.

With reference to FIG. 2, the collar member 64 of midportion 54 includes a stepped annular recess 84 which receives the cylindrical wall 76. Recess 84 includes an upwardly-facing annular disk-bearing surface 86 which contacts the bearing surface **76*a* of midportion 34. The collar 64 includes upwardly-extending protrusions 88. The outer disk-like bearing surface 76*a* of cylindrical wall 76 contacts the bearing surface 86 of collar 64**.

As the cross members 12, 14 are rotated about an axis of rotation 92, the protrusions 88 are brought into and out of engagement with the recesses 78. In addition to the rotational engagement between bearing surfaces **76*a*, 86, the bearing surface 84*a* of midportion 34 rotatably contacts an upper surface 64*a* of collar 64 (see FIG. 2). Additional bearing surfaces are provided at the inner wall 94 of collar 64 and the outer generally cylindrical surface 74*b* of cylindrical wall 76. As can be seen from the above, a plurality of interengaging bearing surfaces are provided at the point of interlocking engagement between the upper midportions 34, 54 of cross members 12, 14**, respectively.

Referring now to the lowermost portion of FIG. 2, the socket member 52 includes an upper annular disk-like bearing surface 52*a*, coplanar with the upper surfaces of frame members 48, 50. An upstanding cylindrical wall 98 has an uppermost annular bearing surface 98*a* and an external cylindrical bearing surface 98*b*.

The midportion 56 of cross member 14 includes a collar 72 defining a stepped inner cylindrical sidewall 104. Referring to the cross-sectional views of FIGS. 6 and 7, the inner cylindrical wall 104 includes a lower, outwardly stepped wall surface 106 in rotatable bearing communication with the outer surface 98*b* of cylindrical wall 98. The stepped recess of collar member 72 also provides an annular bearing surface 108 for contact with the bearing surface 98*a* of midportion 36. A rotational interlocking similar to the protrusions 84 and recesses 78 described above, have been found to be unnecessary in the inner locking of midportions 36, 56. If desired, however, interfitting protrusions and recesses similar to those illustrated in FIGS. 3 and 4 can be provided at the midportions 36, 56, if desired. Also, although generally not preferred, a locking pin can be inserted through aligned apertures in the collar members 44, 64 to provide the desired rotational locking, holding the cross members in the expanded position. Such, however, requires a separately formed component and is therefore not preferred over the unitary construction of the cross members.

Figure 7:
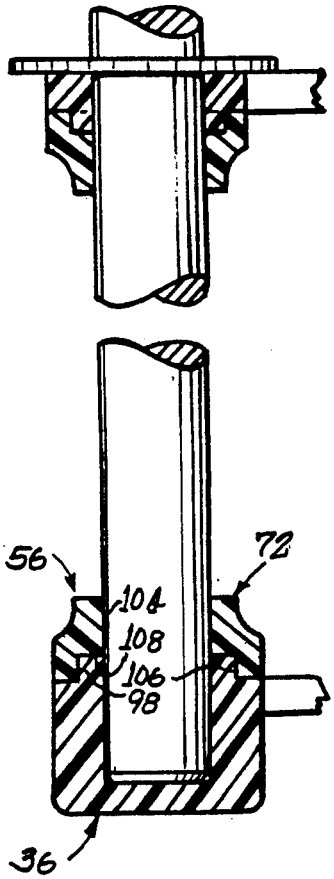
FIG. 7 is a cross-sectional elevational view similar to that of FIG. 6 but showing the central portion of a stand in an open position.

The cylindrical wall 98 and the body portion of socket 52 define a generally cylindrical inner wall surface 100. As seen in FIGS. 6 and 7, the cylindrical walls 100, 104 at the lower portion of the support base form a continuous cylindrical passageway. Similarly, the cylindrical walls 76, 94 at the upper portion of the support base also form a continuous cylindrical passageway, coaxially aligned with the passageway at the bottom of the support base to receive a bushing generally indicated at 112. As illustrated in the upper portions of FIGS. 1 and 5, an elongated shaft 114 is received in bushing 112. Shaft 114 is provided to support a plurality of display racks or arms arranged in a conventional tree-like configuration, for example. The bushing 112 protects the molded plastic collar and socket members illustrated in FIG. 2, as the shaft 114 rotates about its central longitudinal axis. The socket 52 preferably includes a lowermost closed end. If desired, a metallic cylindrical insert can be installed in the cylindrical wall 100 to provide thrust-bearing support for the lower free end of shaft 114. However, it is generally preferred that shaft 114 have an outwardly-extending annular collar 116 affixed thereto which rides on the upper surface of bushing 112, providing the thrust-bearing support for shaft 114, so as to avoid deterioration of socket 52.

Referring to FIGS. 1 and 5–7, the cross member 12 includes a central opening 120 defined by the upper frame members 40, 42 and the lower frame members 48, 50 in combination with the upright frame members 122, 124 extending therebetween. The legs are interfitted, one with the other, by inserting either end, for example, the end 30*b* of cross member 14, into opening 120 and either tilting or compressing the midportion 54 of the cross member to allow registration of the inner cylindrical wall surfaces of the collar and socket members illustrated in FIG. 2. For example, the cross member 14 can be tilted such that its central axis is inclined relative to the central axis of cross member 12.

The frame members 60, 62 at the upper end of cross member 14 and the frame members 68, 70 at the lower end of cross member 14 are resiliently inwardly-compressible to allow a coaxial registration between the midportions of cross member 14 and those of cross member 12. Due to the integral molded construction of plastics material, the frame members 40, 42 and 48, 50 at the lower and upper ends of cross member 12 are resiliently outwardly expandable to facilitate the coaxial registration of the midportions of cross members 12, 14. If desired, only one of the four midportions described above need be made resilient to allow the coaxial registration necessary to form the continuous bushing-receiving passageway.

Figure 5:
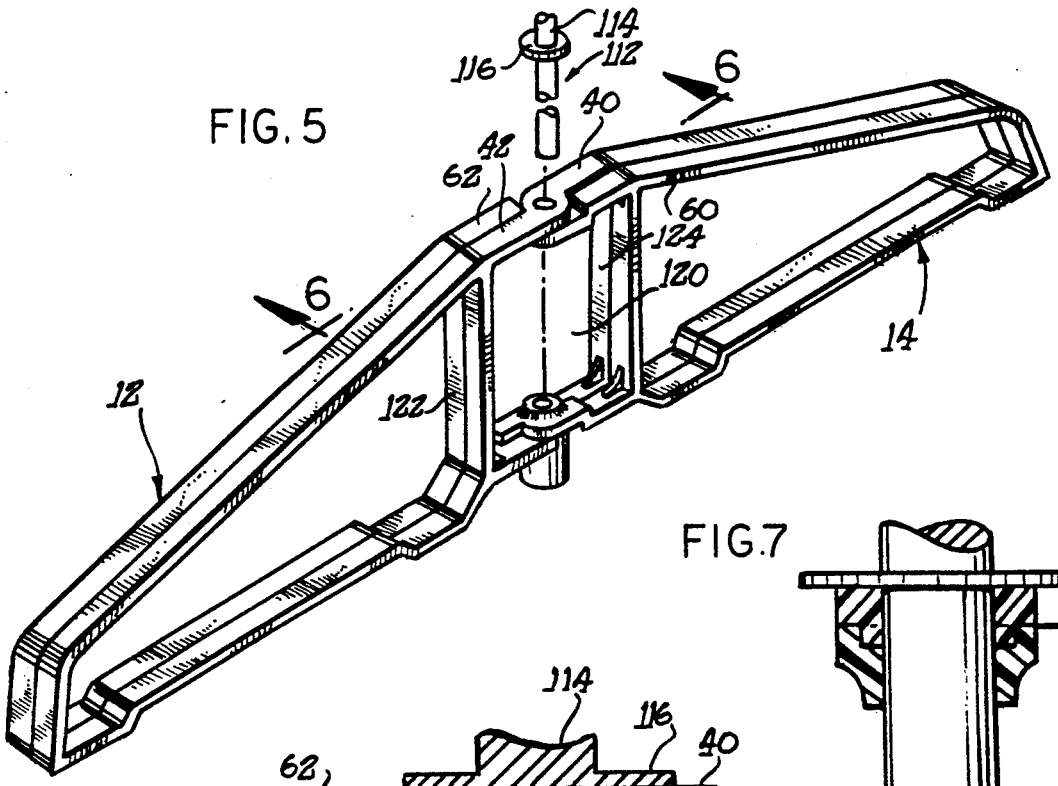
FIG. 5 is a perspective view of the stand of FIG. 1 shown in a collapsed position.
Figure 6:
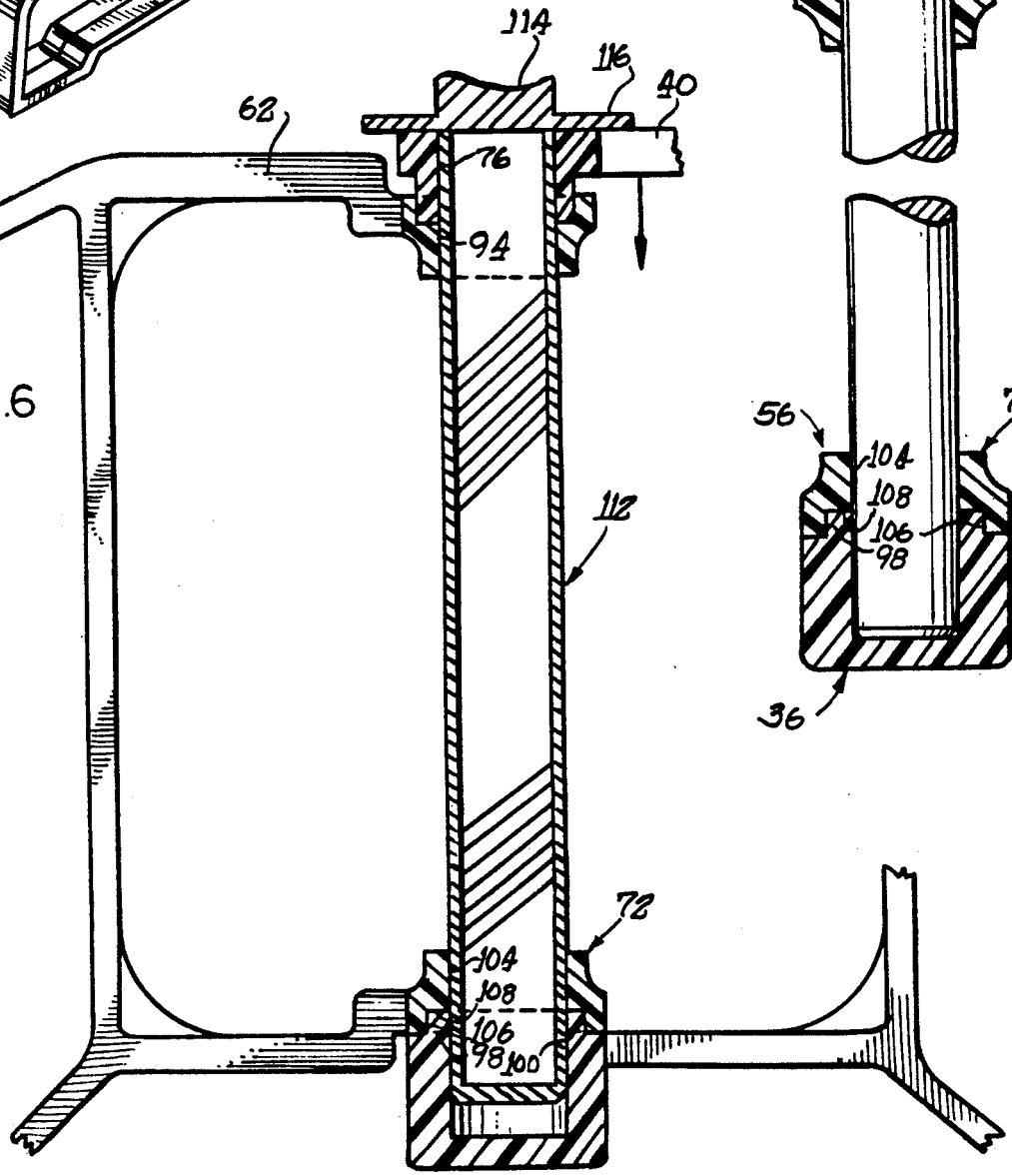
FIG. 6 is a cross-sectional elevational view taken along the lines 6—6 of FIG. 5.

After inserting cross member 14 within cross member 12, and interlocking the cylindrical walls with the recesses at the upper and lower midportions of the cross members, the cross members are rotatably interlocked one with the other, so as to be rotatable between the closed position of FIG. 5 and the open, operable position of FIG. 1. The closed, collapsed position of FIG. 5, as mentioned above, is convenient for shipping the support base in a flat package. When received, the user reconfigures the support base to the open, operable position of FIG. 1 by grasping the cross members 12, 14 and pivoting the cross members for a 90° angular displacement therebetween. As the cross members approach the 90° displacement, the protrusions 88 are received in the recesses 78, locking the cross members in the expanded, operable position so as to provide a stable support base which does not collapse when vibrations or disturbing forces are applied to shaft 114. It has been found that the support base 10 according to the present invention is particularly stable, even for elongated shafts 114 of significant length. For example, the support base 10 provides satisfactory performance with display stands extending 5 to 6 feet above the floor and having the customary plurality of outwardly radiating arms on which merchandise may be hung.

Figure 8:
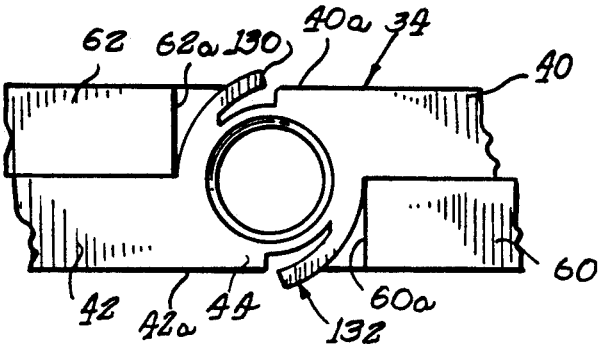
FIG. 8 is a fragmentary plan view of an alternative embodiment of a collar assembly having locking spring fingers.
Figure 9:
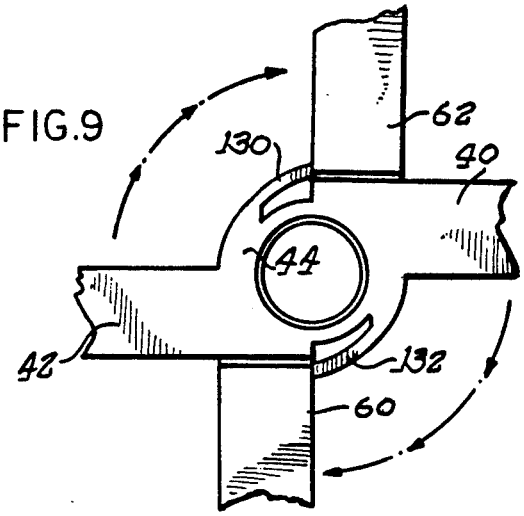
FIG. 9 is a view similar to FIG. 8 but showing the arms of the stand in an expanded configuration with the spring fingers maintaining the arms in a locked position.
Figure 10:
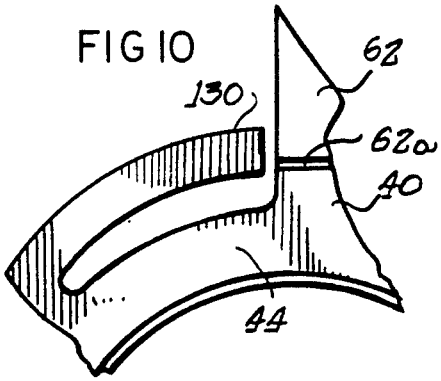
FIG. 10 is a fragmentary view on an enlarged scale showing a spring finger in greater detail.

Referring now to FIGS. 8–10, an alternative arrangement for additional interlocking engagement between the cross members 12, 14 will be described. The upper midportion 34 of cross member 12 has a pair of opposed spring fingers 130, 132 struck out from the collar 44. As illustrated in the top plan view of FIG. 8, the fingers extend in generally clockwise directions and have free ends outwardly protruding from the outward, lateral edges 40*a*, 42*a* of the frame members 40, 42. With the cross members 12, 14 rotated to the open position, the free ends of the spring fingers are cammed against the stepped ledges 60*a*, 62*a*, formed by the recessed collar in the upper midportion 54 of cross member 14. When cammed against the stepped ledges, the spring fingers 130, 132 are resiliently inwardly deflected.

Upon further rotation where the cross members are positioned at approximately right angles to one another, the free ends of the spring fingers clear the stepped ledges, allowing outward resilient expansion of the spring fingers to their relaxed position, illustrated in FIG. 8. When thus expanded, the free ends of the spring fingers butt against lateral edges of the frame members 60, 62 of cross member 14, thus locking the legs in the cross, fully open position, preventing unintentional retraction to the collapsed, storage position of FIG. 5. The resilient spring fingers, 130, 132 are easily manually compressed with finger pressure to allow a collapse of the cross members for storage of the support base. The spring fingers 130, 132 may provide the sole locking of the cross members into the expanded, operable position where they may further enhance the locking provided by the aforementioned protrusions 88 and recesses 78. It will be noted that the spring fingers are easily formed with a simple modification of the mold die of cross member 12 and that no further modification of the support base is necessary for their proper function.

Figure 11:
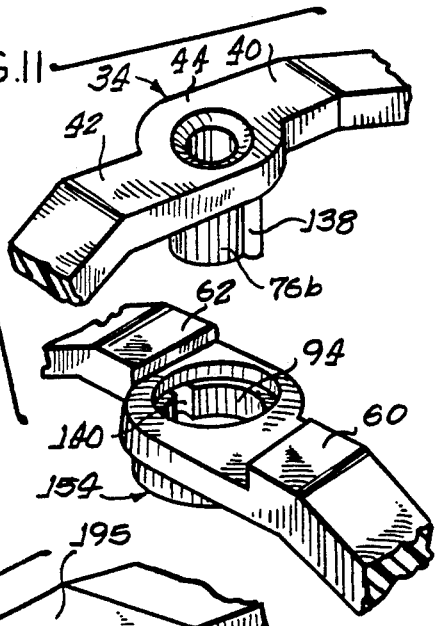
FIG. 11 is a fragmentary perspective view of an alternative collar assembly having a peripheral locking arrangement.
Figure 12:
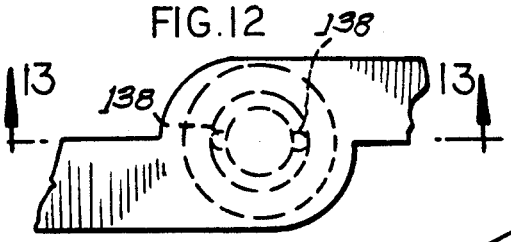
FIG. 12 is a top plan view of the collar assembly of FIG. 11.
Figure 13:
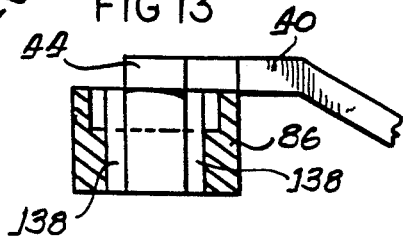
FIG. 13 is a cross-sectional view taken along the line 13—13 of FIG. 12.

Referring now to FIGS. 11–13, an alternative interlocking collar arrangement will be described. In very general terms, the protrusions and recesses illustrated in the upper portion of FIG. 2 are relocated to the cylindrical sidewall surface **76*b* of sidewall 76. A generally vertical rib-like protrusion 38 extends along cylindrical wall 76. A recess 140 extends into the inner wall surface 94 of midportion 54. Upon rotation of the cross members to the expanded, open position of FIG. 1, the protrusion 138 is received in recess 140, thus preventing unintentional retraction of the cross members to the closed, storage position of FIG. 5. If desired, two or more protrusions 138 can be spaced about the periphery of cylindrical sidewall 76. For example, two protrusions 138 are shown in FIGS. 12 and 13**.

If desired, the protrusions 138 can be provided in addition to the protrusions 88 disposed on the recessed collar portion of cross member 14. The interlocking provided by the vertically extending protrusions has in general been found sufficient so as not to require additional interlocking.

Turning now to FIGS. 14–18, an alternative embodiment of a support base according to the present invention is generally indicated at 150. The support base includes cross members 152, 154 which are telescopically inserted one within the other in the manner illustrated in FIG. 16. The cross member 152 has upper and lower central midportions 156, 158, respectively, while the other cross member 154 has upper and lower midportions 160, 162, respectively. The midportions of cross member 152 have upper and lower interior walls 166, 168 which define generally opposed vertically extending channels 170, 172, respectively. In the embodiment of the support base 150, the cross members 152, 154 are not rotationally interconnected, and the embodiment does not include the S-shaped offset configuration described above. Rather, the cross members are interconnected, with one end of cross member 154 being inserted in the channels 170, 172 formed at the midsection of cross member 152. Thus, the midsections of the cross members are of a simplified construction.

Figures 14, 15, 16, 17, 18, 19, 20:
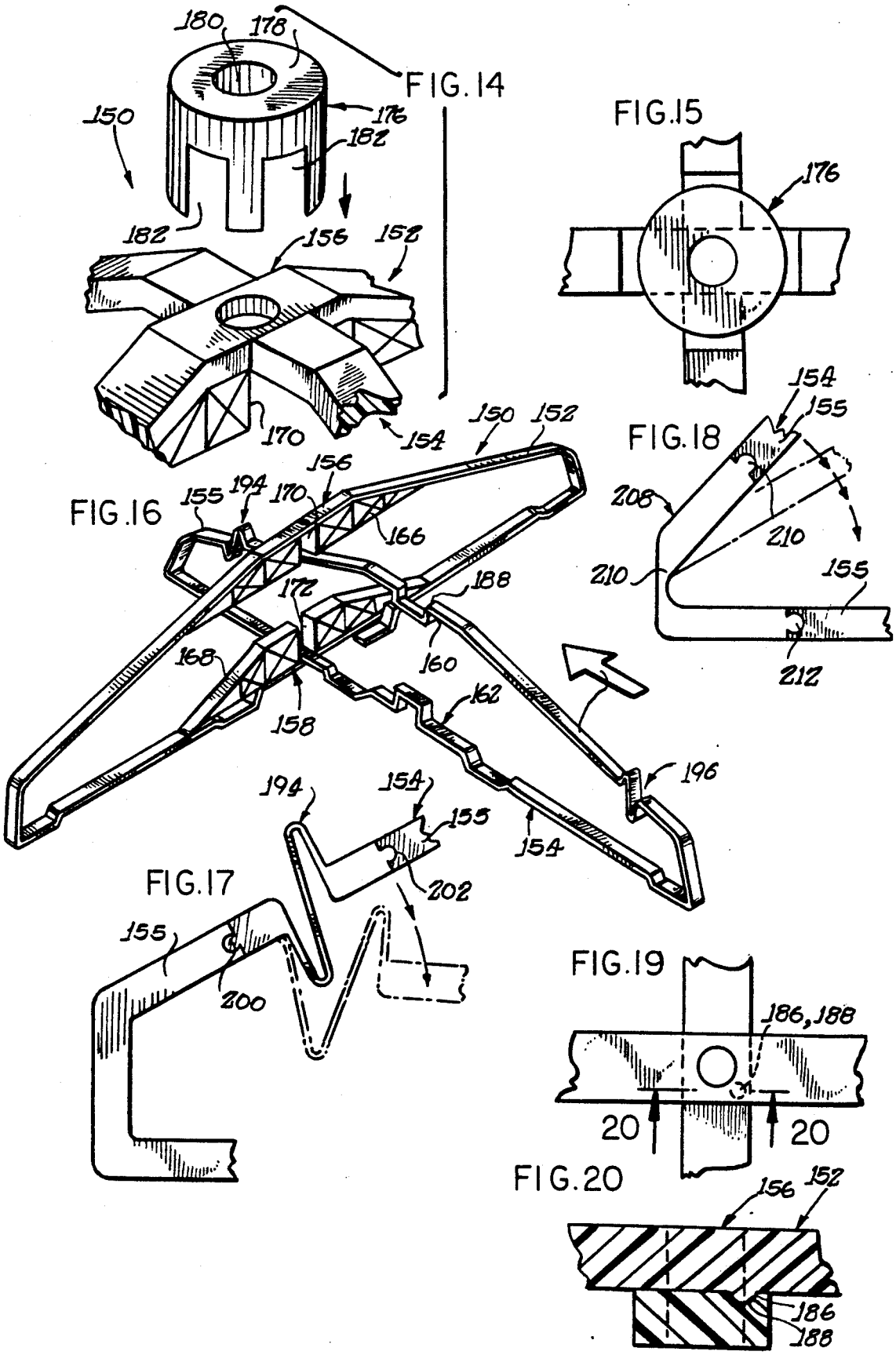
FIG. 14 is a fragmentary perspective view of a further collar assembly wherein a locking collar is telescopically received over a pair of interfitting cross members.
FIG. 15 is a top plan view showing the collar assembly of FIG. 14 in an assembled position.
FIG. 16 is a perspective view of two cross members having an alternative interlocking arrangement.
FIG. 17 is a fragmentary view at the end of one leg of FIG. 16 showing an alternative interfitting modular construction of the end portion of the leg.
FIG. 18 shows an alternative interfitting modular construction of a cross member end portion.
FIG. 19 is a top plan view of an alternative collar portion according to principles of the present invention.
FIG. 20 is a fragmentary cross-sectional elevational view taken along the line 20—20 of FIG. 19.

When the cross member 154 is fully inserted so as to be centered with respect to the cross member 152, a locking collar 176 is inserted over the upper midportion of the cross members, in the manner illustrated in FIG. 15. Locking collar 176 is generally cylindrical in configuration, with an upper end wall 178 defining a shaft-receiving central opening 180. The cylindrical sidewall of locking collar 176 has two crossed channels 182 extending through the center thereof, each channel for receiving the upper portion of a cross member. In order to assist in properly aligning cross member 154 in a position centered with respect to the cross member 152, a downwardly-extending protrusion 186 is provided at the upper midportion 156 of cross member 152. A cooperating recess 188 is formed in an upper surface of midportion 160 of cross member 154. As illustrated in FIG. 19, the protrusion 186 is received in recess 188 to provide locking engagement betWeen the cross members 152, 154, preventing further telescopic insertion of cross member 154 into the midportion of cross member 152.

The cross members 152, 154 of the support base 150 may have a cross-sectional configuration which renders the midportions thereof resilient so as to allow ready telescopic insertion of one cross member within the other. The support base 150 also allows cross members 152, 154 to have a relatively rigid inflexible construction In order to provide the desired interfitting between relatively inflexible cross members, the inner cross member 154 must be compressed to allow the passage of its midportions into the passageways 170, 172 of the cross member 152. In order to provide the necessary compression with a rigid cross member, the cross member 154 is provided with resilient hinge sections 194, 196. As mentioned above, the present invention offers significant commercial advantages by providing cross members which are integrally molded from a material such as plastic.

The hinge members 194, 196 are conveniently provided in the integral molding operation as S-shaped frame portions of reduced thickness. As illustrated in FIG. 17, the S-shaped hinge portion 194 has a cross section substantially thinner than the cross-sectional dimension of the remaining portion of the cross member frame. By localizing the resilient deflection at hinge portion 194, the interlocking engagement between the cross members at their midportions is rendered more stable, and less subject to unintentional dislocation. If desired, the resilient hinge portion 194 may be formed separately of a different plastic material affording a greater resilience, such as nylon, for example. In FIG. 17, the resilient hinge portion 194 has outwardly-extending protrusions 200, 202 which fit within mating channel-like recesses of the frame portions 155 of cross member 154. As illustrated in FIG. 16, two hinge portions are provided adjacent each end of cross member 154. However, only one hinge portion need be provided to allow interlocking engagement between the cross members.

Figure 26:
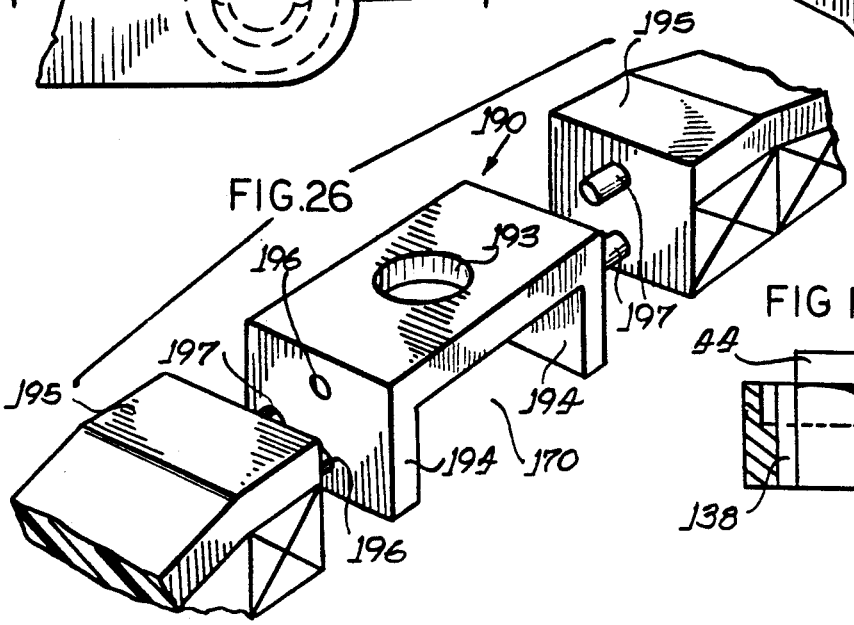
FIG. 26 is an exploded perspective view showing an alternative embodiment of one of the cross members of FIG. 16.

Referring now to FIG. 18, an alternative hinge construction, located at the outer end of the cross members is illustrated. The cross member 154 of FIG. 18 has a resilient end portion generally indicated at 208, with outwardly protruding ribs 210, 212 which provide a snaplock engagement with channel-like recesses formed in the frame members 155 of the cross member 154. The end member 208 has an end portion 210 of significantly reduced thickness, compared to that of the frame members. As illustrated in FIG. 18, a simple snaplock engagement can be provided between the end member and the balance of the cross member, so as to allow the end member to be formed from a softer, more resilient material, such as nylon or the like. This latter arrangement provides a greater range of deflection without compromising the rigidity and strength of cross member 154. However, as mentioned above, it is generally preferred that the hinge 210 be integrally molded with the balance of cross member 154 to provide a simple, economical construction Turning now to FIG. 26, an alternative embodiment of the upper midportion 156 of cross member 152 is generally indicated at 190. The midportion 190 includes a central segment 192 having a central bushing-receiving passageway 193. The central segment 192 includes downwardly extending legs 194 at its ends. The upper midsection includes end portions 195 having a cross-sectional configuration similar to that described above with reference to the central webbing 156 of FIG. 16. In order to provide the snaplock engagement between the midsection 192 and the end portions 195, recesses 196 and pins 197 are formed on the midsection 192 and end sections 195, respectively. When snap fit together, the midportion 190 is similar to the midportion 156, as illustrated in FIG. 16. The arrangement of FIG. 26 allows the midsection 192 to be molded of plastic material different from the balance of the cross member 152. Alternatively, the midsection 192 can be made of cast metal, or the like, to resist enlargement of the shaft-receiving passageway 193 under the distorting force of loads applied to the shaft received therein. Thus, the midsection 192 illustrates one example of an alternative shaft-receiving collar which can be provided at the center of the support base.

Turning now to FIGS. 21–25, an alternative embodiment of the support base is generally indicated at 220. The support base 220 comprises four separately formed legs 222–228. Each leg has a plurality of hinge plates which interfit with one another similar to a loose pin butt hinge to form a continuous shaft-receiving passageway 230, for receiving a bushing 232 and shaft 234 therein. The leg portion 222, for example, includes an upper frame member 232 joined at its inner end to a generally vertical frame member 234. A plurality of outwardly-extending collars or hinge plates 236–240 are formed at the upper end of the vertical frame member 234. The hinge plates 236–240 have central apertures **236*a*–240*a* aligned in registration to form spaced apart portions of the passageway 230**.

Figures 21, 22, 23, 24, 25:
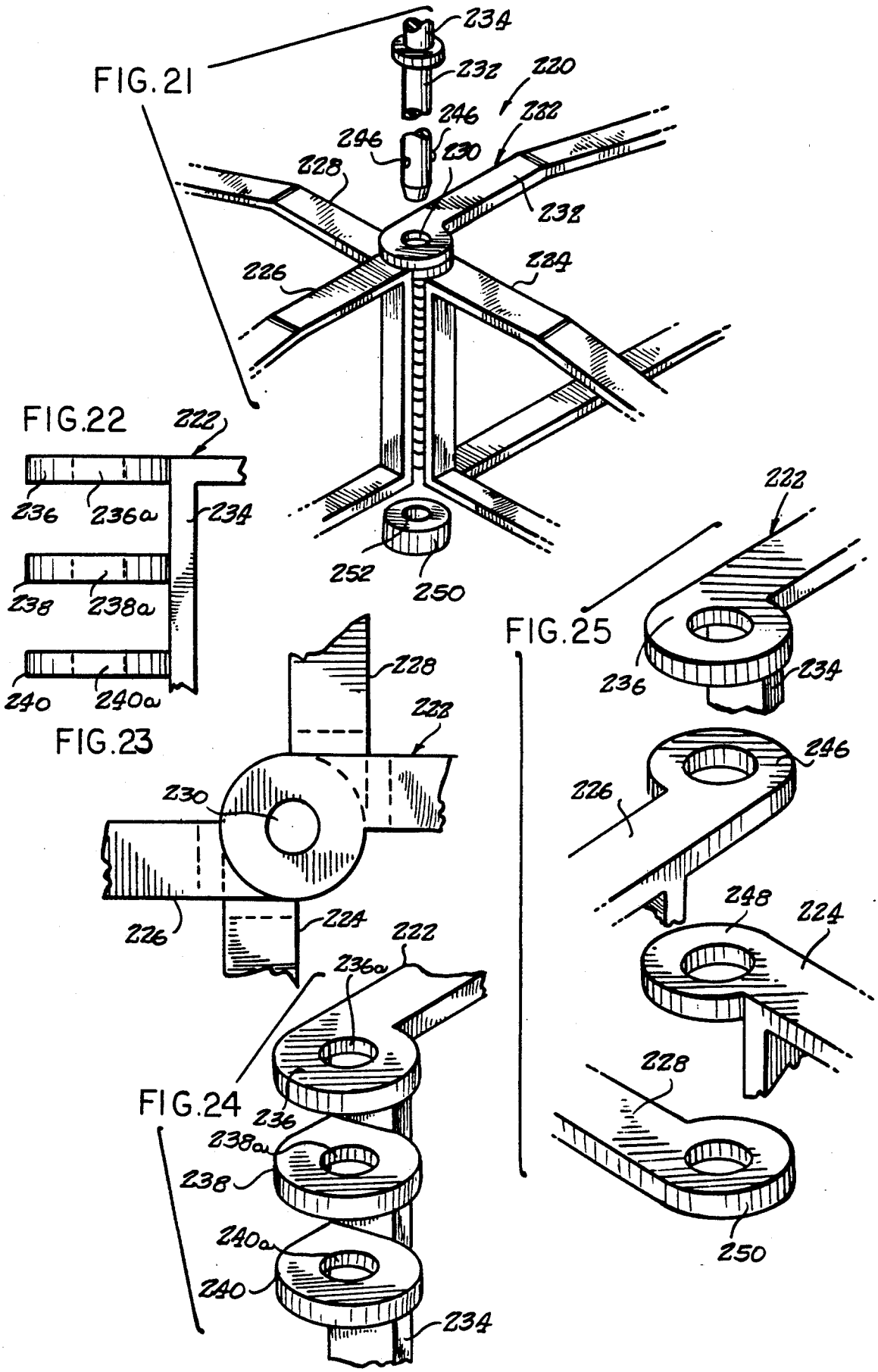
FIG. 21 is a perspective view of another alternative embodiment of a collar assembly according to the present invention.
FIG. 22 is a fragmentary elevational view of one leg of FIG. 21.
FIG. 23 is a fragmentary top plan view of the arrangement of FIG. 21.
FIG. 24 is a fragmentary perspective view of the collar portion of FIG. 22.
FIG. 25 is a fragmentary exploded view, shown in perspective, of the upper portion of the collar assembly of FIG. 21, showing the interlocking of the four legs illustrated therein.

As illustrated in FIG. 21, four legs are interfitted together to form the passageway 230. In the preferred mode of construction, the hinge plates 236, 238 are spaced apart by a distance sufficient to receive similar hinge plates from each of the remaining three legs 224–228. Similarly, the spacing between hinge plates 238, 240 is dimensioned to receive consecutive hinge plates, one from each of the legs 224–228, respectively. With reference to FIG. 25, hinge plate 236 of leg 222 is in the uppermost position, with a hinge plate 246 of leg 226 positioned therebelow. Next, a hinge plate 248 of leg 224 and hinge plate 250 of leg 228 are positioned between the hinge plate 236 and the next adjacent hinge plate 238 of leg 222.

As illustrated in FIG. 25, the annular hinge plates of opposed legs are laterally offset in opposite directions, so as to form the S-shaped configuration of the type described above with reference to FIGS. 1–4, for example. When the hinge plates of the four legs are interfitted one with the other, a continuous shaft-receiving passageway is formed at the center of the support base. Given the relative proportions of the hinge plate thickness and the height of the legs, the hinge plates do not extend to the bottom of the support base. However, those skilled in the art will readily appreciate that the thickness of the hinge plates can be increased in a manner such that, when the hinge plates of all four legs are interfitted, a continuous passageway is formed, completely extending between the top and bottom portions of the support base.

After alignment of the hinge plates of the legs, the bushing 232 is inserted in the passageway 230, thus locking the hinge plates and hence the legs in the desired manner (see FIG. 23.) The legs of the support base are rotatable, one with respect to the other in order to prevent the bushing 232 from pulling out. Once inserted in the passageway, the lower free end of the bushing is preferably provided with a number of outwardly-extending protrusions 246. The protrusions can be located on bushing 232 so as to engage the lowermost hinge plate, thus preventing upward withdrawal of the bushing. Alternatively, an end cap 250 with a central shaft-receiving passageway 252, can be provided for this purpose (see FIG. 21). If desired, the support base 220 can be made from relatively rigid, inflexible plastic material, as no resilient deflection is required to assemble the support base.

It will thus be seen that the objects hereinbefore set forth may readily and efficiently be attained and, since certain changes may be made in the above construction and different embodiments of the invention without departing from the scope thereof, it is intended that all matter contained in the above description or shown in the accompanying drawings shall be interpreted as illustrative and not in a limiting sense.

What is claimed is:

1. A collapsible support base for receiving an end of an elongated shaft so as to support portions of the shaft extending beyond the base, said collapsible support base comprising:

a pair of cross members made of plastic and being interfitted with each other to swing between a collapsed position and an open position, each cross member including a pair of upper and a pair of lower opposed leg portions, the lower legs having outer ends for engaging the floor and for supporting the base and elongated shaft, inner ends on the upper and lower leg portions, the opposed leg portions being spaced from each other, detent means on the collapsible support base to detent the cross members in an open position to support the shaft, upper and lower cross bars spanning the inner ends of the opposed leg portions, hub portions at the center of the cross bars on each of the cross members for mating rotational engagement and having openings therein to receive the elongated shaft, upright frame members extending between the upper and lower leg portions to make the cross members more rigid for supporting a load thereon, the cross bars defining upper and lower sides of a central opening and the upright frame members defining opposite sides of a central opening, said cross bars spanning the opening, said cross bars being deflectable with the cross members adapted to be interfitted upon insertion of a leg portion of one cross bar between the upright frame members of the other cross member and deflecting the cross bars to engage the hub portion on the inserted cross bar inside of the hub portion on the outer cross member.

2. A collapsible support in accordance with claim 1 in which the upper and lower cross bars have portions laterally offset from each other and in parallel planes, the cross bars of one cross member being rotatable to contiguously adjacent the cross bar of the other cross member when the base is in the collapsed position.

3. A collapsible support base in accordance with claim 1 in which a hub portion on a first cross member comprises a cylindrical sidewall projecting from its cross bar, a hub portion on the other cross bar having a substantially cylindrical socket, said cylindrical sidewall being journaled in the cylindrical socket to rotatably mount the first and second cross members to each other for swinging movement.

* * * * *